US010315218B2

(12) United States Patent
Mahalingam et al.

(10) Patent No.: US 10,315,218 B2
(45) Date of Patent: Jun. 11, 2019

(54) METHOD FOR REPAIRING TURBINE COMPONENT BY APPLICATION OF THICK COLD SPRAY COATING

(71) Applicant: General Electric Company, Schenectady, NY (US)

(72) Inventors: Anantharaman Mahalingam, Bangalore (IN); Prabhakaran Manogharan, Bangalore (IN); Shalini Thimmegowda, Bangalore (IN); Eklavya Calla, Bangalore (IN); Gopi Chandran Ramachandran, Bangalore (IN)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 15/642,622

(22) Filed: Jul. 6, 2017

(65) Prior Publication Data

US 2019/0009300 A1 Jan. 10, 2019

(51) Int. Cl.

| | |
|---|---|
| ***B05D 1/12*** | (2006.01) |
| ***B05D 3/02*** | (2006.01) |
| ***B05D 5/00*** | (2006.01) |
| ***B05D 7/14*** | (2006.01) |
| ***C23C 24/04*** | (2006.01) |
| ***C23C 26/00*** | (2006.01) |
| ***C23C 28/02*** | (2006.01) |
| ***C23C 30/00*** | (2006.01) |

(52) U.S. Cl.

CPC ..... *B05D 1/12* (2013.01); *B05D 3/0254* (2013.01); *B05D 5/005* (2013.01); *B05D 7/14* (2013.01); *C23C 24/04* (2013.01); *C23C 26/00* (2013.01); *C23C 28/022* (2013.01); *C23C 30/00* (2013.01); *C23C 30/005* (2013.01); *B05D 2202/40* (2013.01); *F05D 2230/31* (2013.01)

(58) Field of Classification Search

CPC ..... C23C 24/04; C23C 26/00; C23C 28/022; C23C 30/00; C23C 30/005; B05D 1/12; B05D 3/0254; B05D 5/005; B05D 7/14; B05D 2202/40; F05D 2230/31; F05D 2231/80

See application file for complete search history.

(56) References Cited

U.S. PATENT DOCUMENTS

| | | | | |
|---|---|---|---|---|
| 3,753,790 A * | 8/1973 | Walker | C22F 1/10 | 148/404 |
| 5,302,414 A * | 4/1994 | Alkhimov | B05B 7/144 | 427/191 |
| 6,491,208 B2 | 12/2002 | James et al. | | |
| 6,780,458 B2 * | 8/2004 | Seth | C23C 24/04 | 427/201 |

(Continued)

*Primary Examiner* — William P Fletcher, III
(74) *Attorney, Agent, or Firm* — Dority & Manning, P.A.

(57) ABSTRACT

A method for repairing a Ni-based alloy component includes preparing a surface of the Ni-based alloy component for receiving a cold spray repair; spraying a stream of particles onto a the surface of the Ni-based alloy component to form a coating thereon; and removing any over-spray on the surface of the Ni-based alloy component. The particles are formed from an alloy material having a melting point such that the particles are sprayed at a spray temperature that is less than the melting point of the alloy material.

17 Claims, 2 Drawing Sheets

(56) References Cited

U.S. PATENT DOCUMENTS 6,905,728 B1 * 6/2005 Hu ..... B22F 7/08 427/140
7,455,881 B2 * 11/2008 Raybould ..... C23C 24/04 427/191
7,631,816 B2 12/2009 Jabado et al.
8,192,799 B2 6/2012 Kay et al.
8,261,444 B2 * 9/2012 Calla ..... B23P 15/006 29/527.1
9,027,374 B2 5/2015 Forbes Jones et al.
9,109,291 B2 8/2015 Lamberton et al.
9,347,136 B2 5/2016 Verrier et al.
9,394,063 B2 7/2016 Jackson et al.
9,433,957 B2 9/2016 Nardi et al.
9,598,774 B2 3/2017 Ajdelsztajn et al.
2004/0126499 A1 * 7/2004 Heinrich ..... C23C 24/04 427/421.1
2005/0214474 A1 * 9/2005 Han ..... B05B 7/1486 427/446
2006/0166020 A1 * 7/2006 Raybould ..... C23C 24/04 428/471
2006/0222776 A1 * 10/2006 Madhava ..... C23C 2/04 427/446
2006/0260126 A1 * 11/2006 Groh ..... B22F 3/004 29/889.2
2007/0144621 A1 * 6/2007 Farmer ..... C22C 45/00 148/403
2007/0186416 A1 * 8/2007 Birkner ..... B23P 6/002 29/889.1
2009/0297701 A1 12/2009 Jabado et al.
2012/0034092 A1 * 2/2012 Jakimov ..... C23C 4/08 416/229 A
2014/0260478 A1 * 9/2014 Forbes Jones ..... B21J 1/02 72/47
2017/0369187 A1 * 12/2017 Choi ..... B64F 5/40

* cited by examiner

METHOD FOR REPAIRING TURBINE COMPONENT BY APPLICATION OF THICK COLD SPRAY COATING

FIELD OF TECHNOLOGY

The present disclosure relates generally to cold spray methods of forming coatings. In particular, present disclosure relates to methods of forming relatively thick coatings via cold spraying feedstocks, including nickel-base alloys.

BACKGROUND

A gas turbine engine typically includes a turbomachinery core having a high pressure compressor, combustor, and high pressure turbine in serial flow relationship. The core is operable in a known manner to generate a primary gas flow. The high pressure compressor includes annular arrays ("rows") of stationary vanes that direct air entering the engine into downstream, rotating blades of the compressor. Collectively one row of compressor vanes and one row of compressor blades make up a "stage" of the compressor. Similarly, the high pressure turbine includes annular rows of stationary nozzle vanes that direct the gases exiting the combustor into downstream, rotating blades of the turbine. Collectively one row of nozzle vanes and one row of turbine blades make up a "stage" of the turbine. Typically, both the compressor and turbine include a plurality of successive stages. Gas turbine engines, particularly aircraft engines, require a high degree of periodic maintenance. For example, engine components may exhibit wear during operation and often require repairs to restore its original dimensions and geometry.

Thermal spray coating repairs are often performed on engine components for dimensional build-up. However, the resulting repair material has debited properties due to oxidation and/or porosity as part of thermal spray processes. In particularly damaged components, such as those formed from nickel-based superalloys, thermal spray coating repair processes have not been successful for relatively thick coatings. That is, current repair processes, such as thermal spray coating, have not been very successful in depositing layers beyond about 1.5 mm thickness with properties similar to original base material.

As such, an improved method for repairing a nickel-based superalloy component is needed, particularly when requiring a coating of greater than 1.5 mm.

BRIEF DESCRIPTION

Aspects and advantages will be set forth in part in the following description, or may be obvious from the description, or may be learned through practice of the invention.

A method is generally provided for repairing a Ni-based alloy component. In one embodiment, the method includes preparing a surface of the Ni-based alloy component for receiving a cold spray repair; spraying a stream of particles onto the surface of the Ni-based alloy component to form a coating thereon; and removing any over-spray on the surface of the Ni-based alloy component. For example, the particles are formed from an alloy material having a melting point such that the particles are sprayed at a spray temperature that is less than the melting point of the alloy material.

These and other features, aspects and advantages will become better understood with reference to the following description and appended claims. The accompanying drawings, which are incorporated in and constitute a part of this specification, illustrate embodiments of the invention and, together with the description, serve to explain certain principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which.

Figure 1:
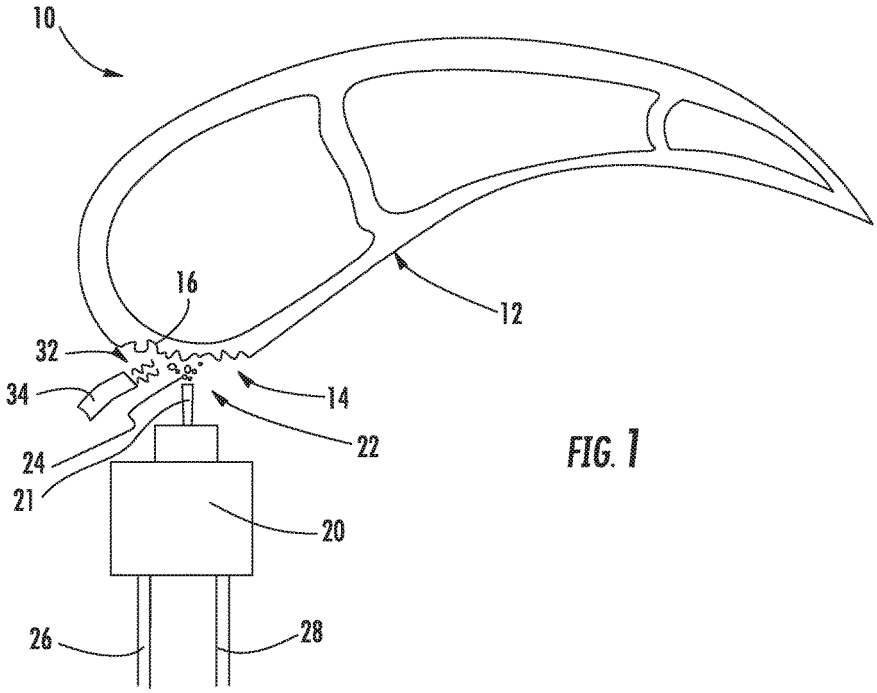
FIG. 1 shows an exemplary component being repaired by a cold spray process at a damaged portion of its surface.

Repeat use of reference characters in the present specification and drawings is intended to represent the same or analogous features or elements of the present invention.

DETAILED DESCRIPTION OF PARTICULAR EMBODIMENTS

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In the present disclosure, when a layer is being described as "on" or "over" another layer or substrate, it is to be understood that the layers can either be directly contacting each other or have another layer or feature between the layers, unless expressly stated to the contrary. Thus, these terms are simply describing the relative position of the layers to each other and do not necessarily mean "on top of" since the relative position above or below depends upon the orientation of the device to the viewer.

Chemical elements are discussed in the present disclosure using their common chemical abbreviation, such as commonly found on a periodic table of elements. For example, hydrogen is represented by its common chemical abbreviation H; helium is represented by its common chemical abbreviation He; and so forth.

Methods are generally provided for forming a repaired coating on a surface of a Ni-based alloy component, such as a Ni-based superalloy component. For example, a defect (e.g., a crack, indentation, or other surface irregularity) in the surface of the Ni-based alloy component may be repaired using cold spray coating techniques to fill in the defect to restore the surface of the Ni-based alloy component. In one embodiment, the cold spray coating techniques may be utilized to repair the Ni-based alloy component to its original shape. Thus, worn areas on the Ni-based alloy component may be restored to its original blue print dimensions. As such, cold spray based repair processes may reduce scrap and can salvage damaged engine components for future use.

Referring to FIG. 1, an exemplary component 10 is shown in the form of an airfoil (e.g., of a turbine blade) of a turbine engine. However, it is to be understood that the component 10 is not limited to any particular shape or component, and may be any suitable alloy component. In one embodiment, the component 10 is formed from a metal or a metal alloy. Examples include metals such as nickel, cobalt, titanium, aluminum, zirconium, and copper. Examples of metal alloys include nickel-base alloys, cobalt-base alloys, titanium-base alloys, iron-base alloys, steels, stainless steels, and aluminum-base alloys.

In one particular embodiment, the component 10 is formed from a nickel-based alloy. Nickel-based superalloys are commercially available under the trade name RENE® is a non-limiting example that is particularly beneficial to be used for the engine components. RENE® is a registered trademark of Teledyne Industries, Inc. of Los Angeles, Calif. While different component materials are encompassed by this disclosure, the description below of the component utilizes nickel-base alloys as the component material as one particular embodiment. A non-limiting example of a nickel-base alloy is alloy 718, having a specific composition, in weight percent, from about 50 to about 55 percent nickel, from about 17 to about 21 percent chromium, from about 4.75 to about 5.50 percent niobium, from about 2.8 to about 3.3 percent molybdenum, from about 0.65 to about 1.15 percent titanium, from about 0.20 to about 0.80 percent aluminum, 1.0 percent maximum cobalt, and balance iron. Small amounts of other elements such as carbon, manganese, silicon, phosphorus, sulfur, boron, copper, lead, bismuth, and selenium may also be present.

Strengthened nickel-base alloys generally include precipitated phases, such as for example, gamma-prime (γ'), gamma-double prime (γ"), and high-temperature precipitates such as, for example, carbides, oxides, borides, and nitride phases, either singularly or in combination, depending on the alloy composition and heat-treatments conditions of the alloy. In some embodiments, phases such as delta, sigma, eta, mu, and/or laves may also be present. The precipitate phases such as gamma-prime and gamma-double prime in nickel base alloys are typically dissolved during solution heat-treatments, and re-precipitate during cooling from the solution temperature and during subsequent aging heat-treatments. The result is a distribution of gamma-prime and/or gamma-double prime secondary phases in a nickel-alloy matrix. High-temperature precipitates such as carbides, oxides, borides, and nitride phases may not typically dissolve during solution heat-treatments and may thus remain as precipitates even after solution heat-treatment of the alloys.

In typical precipitate hardened nickel alloys, the alloys are initially given a solution treatment (or, in the parlance of the art, the alloys are initially "solutioned" or "solutionized"), wherein the alloys are heated above the solvus temperature of the precipitates. The precipitates referred herein may be the 'primary', 'secondary', or 'tertiary' precipitates that form during different stages of temperature-treatments rather than the high temperature carbide, oxide, boride, or nitride phases that may be present even above the solvus temperatures of the primary/secondary/tertiary precipitates.

Generally, the alloys are quenched after solution treatment forming a supersaturated solid solution phase. In one embodiment, the matrix includes nickel-base gamma (γ) phase. The gamma-phase is a solid solution with a face-centered cubic (fcc) lattice and randomly distributed different species of atoms. In some alloys, where the high temperature precipitate phases are present, the supersaturated solid solution phases may still have the precipitates of those high temperature phases. In one embodiment, in a gamma-prime system like Rene 88® or Waspaloy® for example, the gamma prime may precipitate quickly even during quenching. Typically, alloys in the solutioned state, even where precipitation occurs during quenching, are significantly softer than alloys in the fully processed state, as noted below.

In the third step, the supersaturated solid solution phase is heated below the solvus temperature of the precipitates to produce a finely dispersed precipitate. For example, in a gamma-double prime system, the gamma-double prime phase may largely precipitate during the aging treatment thereby hardening and strengthening the alloy.

Thus, strengthened nickel-base alloys are typically processed by using designed solution heat-treatment methods that dissolve gamma-prime and/or gamma-double prime strengthening phases and then allow the optimum reprecipitation of these phases upon cooling from heat-treatment or after subsequent aging of the solutioned alloys. The cooling rate, and cooling path imposed on nickel-base alloy components, along with the aging temperature and times, and inherent properties of the particular compositions normally influence development of optimum properties in the nickel-base alloys.

Referring again to FIG. 1, the component 10 (e.g., a Ni-based alloy component) has an outer surface 12 that includes a damaged portion 14 thereon. The damaged portion 14 is shown including defects 16 therein, which may be in the form of a crack, indentation, or other surface irregularity where material is removed from the original component 10 or otherwise damaged. For example, the defect 16 may extend relatively deep into the original surface (e.g., up to about 6 mm, such as about 1.5 mm to about 6 mm). In certain embodiments, the defect 16 may extend about 2.5 mm to about 5 mm into the original surface (e.g., about 3.0 mm to about 5 mm).

In one embodiment, the component 10 is prepared for receiving the coating thereon. Preparing the component 10 for the cold spray may include cleaning and/or degreasing the surface 12, and in particular the damaged portion 14. In one embodiment, a prepared region of the surface 12 is formed by removing the existing material or layer such as an oxide layer for example, from the surface 12 of the component 10 so that the coating is formed directly on the material of the component 10 so as to bond directly to the component 10.

As shown in FIG. 1, a cold spray gun 20 is shown spraying a stream 22 of particles 24 onto the damaged portion 14 of the surface 12 within the component 10. Typical cold spray methods use a spray gun 20 that receives a high pressure gas and a feedstock of deposit material, such as through the respective feed tubes 26, 28. For example, the high pressure gas may be an inert gas that does not chemically react with the deposit material or the component 10, including but not limited to helium, nitrogen, air, etc.

During cold spraying, the powder granules are introduced at a high pressure into the gas stream in the spray gun 20 and emitted from a nozzle 21. The particles 24 are accelerated to a high velocity in the gas stream that may reach a supersonic velocity. In particular embodiments, the particles 24 may have a flow function value that is about 10 or less such that the particles 24 flow easily from the nozzle 21 of the spray gun 20.

Although referred to as a cold stream process, the gas stream may be heated, but to a sprayed temperature that is less than the melting point of the particles to minimize in-flight oxidation and phase changes in the deposited material. For example, the particles 24 may be sprayed at a temperature of about 500° C. to about 1100° C. (e.g., about 650° C. to about 1100° C.). In one embodiment, the particles 24 may be sprayed at a relatively low temperature (e.g., about 500° C. to about 800° C., such as about 650° C. to about 800° C.). In other embodiments, the particles 24 may be sprayed at higher temperatures, but still below the melting point of the particle material (e.g., about 800° C. to about 1100° C., such as about 800° C. to about 950° C.). As a result of the relatively low deposition temperatures (i.e., below the melting point of the particle material) and very high velocities, cold spray processes offer the potential for depositing well-adhering, mechanically/metallurgically bonded, dense, hard and wear-resistant coatings whose purity depends primarily on the purity of the feedstock powder used.

The powder 24 impacts damaged portion 14 the surface 12 of the component 10 at a high velocity. The kinetic energy of the powder 24 causes the powder granules to deform and flatten on impact with the component 10. The flattening promotes a metallurgical, mechanical, or combination of metallurgical and mechanical bond with the substrate and results in a deposit on the substrate. One advantage of cold spraying methods is the negligible to nil phase change or oxidation of particles 24 during flight and high adhesion strength of the bonded particles 24.

Changing some characteristics of the feedstock microstructure and/or morphology to effect reduction of particle strength and/or hardness (relative to such characteristics and properties for particles received after typical powder manufacturing processes) provides a softer particle feedstock be fed to the spray apparatus, allowing a softer material to impact and deform at the substrate and thus forming a dense, high quality deposit. Some embodiments of the disclosed method include a heat-treatment of the feedstock material that changes the material structure and property, making the feedstock amenable for cold-spraying at economically convenient conditions. The disclosed method is different from an in-situ or inside-the-spray gun heat-treatment of the feedstock material during or just before spraying out the feedstock. The feedstock material used herein receives its heat-treatment and thus changes its microstructure, morphology and/or strength/hardness, even before introduction into the cold spray apparatus. Further, the heat-treatment that is received by the feedstock material in this application is different than what can be applied inside a spray gun apparatus.

The deposit material may include a metal and/or a metal alloy, such as, for example, metals, refractory metals, alloys, or composite materials in powder form. In one embodiment, the deposit material has a composition that is compatible with the material of the component 10, such as having a composition that is substantially identically to the material of the component 10 (as formed). However, the deposition materials may have a composition that is different than that of the material of the component 10 in other embodiments.

In one particular embodiment, the particles 24 are formed from a nickel-based alloy, such as those described above with respect to the material of the component 10 (e.g., RENE®). While different component materials are encompassed by this disclosure, the description below of the component utilizes nickel-base alloys as the particle material as one particular embodiment. A non-limiting example of a nickel-base alloy is alloy 718, having a specific composition, in weight percent, from about 50 to about 55 percent nickel, from about 17 to about 21 percent chromium, from about 4.75 to about 5.50 percent niobium, from about 2.8 to about 3.3 percent molybdenum, from about 0.65 to about 1.15 percent titanium, from about 0.20 to about 0.80 percent aluminum, 1.0 percent maximum cobalt, and balance iron. Small amounts of other elements such as carbon, manganese, silicon, phosphorus, sulfur, boron, copper, lead, bismuth, and selenium may also be present.

In certain embodiments, the cold spray methods may be utilized to form a coating 30 that is a hybrid coating (e.g., a combination of materials) and/or has a graded coating composition. For example, multiple spray guns may be utilized to form such a coating composition. Alternatively, the particle feedstock may be intermittent changed in composition during the cold spray deposition process.

Figure 2:
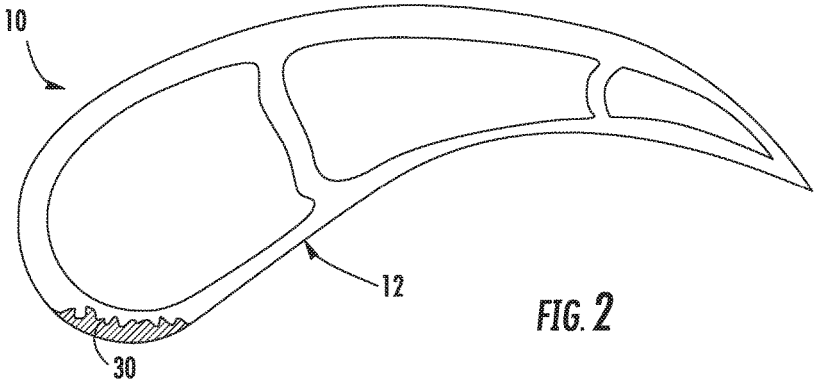
FIG. 2 shows the exemplary component of FIG. 1 repaired by the cold spray process at the damaged portion of its surface.
Figure 3:
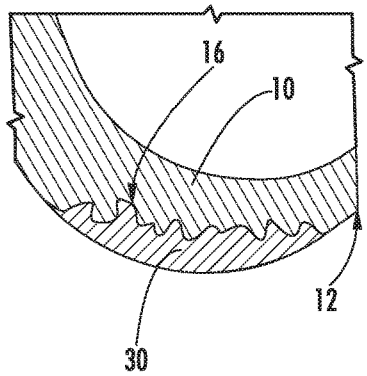
FIG. 3 is an close-up of an exemplary repaired component using a cold spray process.

Upon deposition, the particles 24 form a coating 30 within the damaged portion 14 on the surface 12 of the component 10, as shown in FIGS. 2 and 3. For example, the coating 30 may be formed up to a thickness of about 6 mm, such as about 1.5 mm to about 6 mm) on the damaged portion 24. In certain embodiments, the coating 30 may have a thickness of about 2.5 mm to about 5 mm on the damaged portion 24 (e.g., about 3.0 mm to about 5 mm).

Heat treatment of the coating can further enhance mechanical properties of the coating applied via cold spray techniques. In one embodiment, the cold sprayed coating 30 may be heated concurrently during the cold spray process in order to potentially reduce/eliminate post-spray heat treatments. For example, thermal energy 32 may be directed at the surface 12 using a heat gun 34 (or other heating device) during the coating process. In one embodiment, the coating 30 is heated to a treatment temperature of about 250° C. to about 1000° C. (e.g., about 400° C. to about 500° C.) during the cold spraying process.

However, in other embodiments, a post spraying heat treatment may be performed to heat the applied coating 30. For example, thermal energy may be directed to the coating 30 after its formation (e.g., using a heat gun, a hot isostatic press, or other heating device). Alternatively, the component 10 may be placed in an oven and heated for heat treatment of the coating 30. In one embodiment, the coating 30 is heated to a treatment temperature of about 900° C. to about 1300° C. (e.g., about 1000° C. to about 1200° C.) after its formation by the cold spraying process. Such a heat treatment may be performed for a period of at least about 30 minutes, such as about 30 minutes to about 5 hours (e.g., about 1 hour to about 4 hours).

In one embodiment, the coating 30 is a highly dense coating that may lead to an increase in tensile strength of the material. For example, the porosity of the coating 30 may be about 5% or less (e.g., about 0.1% to about 5%) upon heat treatment of the as-deposited coating. The coating formed may has a tensile strength that is about 100% to about 130% of the tensile strength of the original Ni-based alloy component (e.g., about 110% to about 125%). Without wishing to be bound by any particular theory, it is believed that the enhanced tensile property of the coating post heat treatment was due to the formation of Gamma prime and diffusion bond at interface. The heat treatment may also close any delamination at the interface of the coating 30 and may form a diffusion bond with the underlying layers/surfaces.

In one embodiment, the coating 30 is made of a nickel-base alloy deposits strengthened by the presence of gamma-prime and/or gamma-double prime phases. In particular embodiments, the microstructure of coating 30 after the heat treatment has a fine microstructure with Gamma prime strengthening precipitate formation, whereas the as-sprayed coating showed heavy deformation. The coating process includes the steps of solution heat-treating a nickel-base alloy powder at a solutionizing temperature above gamma-prime and/or gamma-double prime solvus temperatures of the nickel-base alloys. In one embodiment, the coating process further includes quenching the nickel-base alloy powders to a temperature less than the gamma-prime and gamma-double prime solvus temperatures. The quenching may be carried out in one step or in multiple steps. Normal air quenching or water, oil, or molten salt bath quenching methods may be used for the quenching.

In one embodiment, the solution heat-treated and quenched powders are used as at least a part of the feedstock for the cold-spray deposition. The solution treatment is normally performed at temperatures sufficiently high to partially or fully dissolve the strengthening phases, typically on the order of 900° C. to 1300° C. for nickel-base alloys, typically for a duration of 1 hour to 10 hours. In certain embodiments, the heat treatment may be performed under a vacuum (e.g., vacuum heat treatment).

This solution heat-treatment and quenching alters the microstructure of the nickel-base alloys and the resultant particles typically have a thermally altered microstructure. In one embodiment, the altered microstructure of the nickel-base alloy refers to the changed microstructure from the atomized state of the nickel-base alloy prior to a heat-treatment to the atomized powder. A thermally altered microstructure, then, refers to a microstructure that has microstructural features that differ from the features of the powder prior to heat-treatment as a result of having been exposed to heat-treatment. Non-limiting examples of such features include grain size; grain morphology; precipitate size, morphology, and size distribution; and degree of chemical segregation. In one embodiment, the materials are thermally processed using a heat-treatment that results in the material being softer than it was prior to the treatment. In one embodiment, the atomized nickel-base alloys are heat-treated to a temperature of at least half the melting point of the nickel-base alloy for a duration of at least 5 minutes to develop a thermally altered microstructure. The melting temperature as defined herein means the incipient melting point of the alloy, wherein a liquid phase begins to appear under equilibrium conditions.

In one embodiment, the quenched powders, before receiving further aging heat-treatment, are in a single phase supersaturated solution phase, without having the presence of any of the gamma-prime or gamma-double prime phase precipitates. In one embodiment, the quenched powders comprise substantially solutioned microstructure. As used herein the "substantially solutioned microstructure" means that the powder particles are in a solution-treated state having a microstructure characteristic of material having been through a solution heat-treatment and rapid quench. In most embodiments, high temperature phases such as carbides, oxides, nitrides, and borides, if present in the powder prior to heat-treatment, persist within the matrix after heat-treatment. In one embodiment, a solution treatment is a heat-treatment to a temperature where thermodynamics favor existence as a single phase, for a time sufficient to establish equilibrium conditions.

In one embodiment, the solution treated and quenched state includes matrix phase and precipitate phases that formed during quenching without undergoing any aging treatment to form post-primary fine precipitates that aid in increasing strengthening. In one embodiment, a matrix phase of gamma nickel and gamma-prime primary precipitate is present in the solution treated and quenched nickel-base alloy. In one embodiment, the nickel-base alloys are subjected to slow-quenching from the solution temperature. Cooling the materials while leaving them in the heat treatment furnace (a practice known in the art as "furnace cooling") is a typical method of slow-quenching in these alloys systems. The slow-quenched alloys materials typically have coarser grains precipitates and reduced strength compared to conventionally aged alloys of similar composition.

In one embodiment, the feedstock particles used for the cold spray include a nickel base alloy. In one embodiment, the nickel-base alloy includes feedstock particles having at least about 40% of nickel by weight.

In one embodiment, the microstructure of the solution heat-treated and quenched feedstock powders include coarse grains. As used herein, "grains" are individual crystals and the grain size refers to size of crystals within a given particle.

In one embodiment, the strength of the nickel-base alloys is reduced by the solution heat-treatment, relative to the powders before subjecting to the heat-treatment, due to grain coarsening and/or precipitate dissolution associated with solution heat-treating. In one embodiment, the particles of the feedstock materials have average grain size ranging from about 1 μm to about 20 μm. Feedstock materials with different particle sizes can be used in the cold spray method presented herein to form strong and dense deposits. In one embodiment, the particles used for the feedstock have a median size in the range from about 1 micron to about 100 microns. In a further embodiment, the particles have a median size in the range from about 5 microns to about 50 microns. In one embodiment, the particles obtained after solution heat-treatment and quenching have a face-centered cubic crystal structure.

As discussed previously, in one embodiment of the cold spray method presented herein, the feedstock material does not melt at the time of spraying. In one embodiment, the melting point of the feedstock material is above the temperature experienced by the feedstock material during spraying. In a further embodiment, the temperature experienced by the feedstock material is below about 0.9 times the melting point of the feedstock material.

In one embodiment of the invention, a carrier gas is used for carrying the feedstock materials for depositing. Because of the change in microstructure and decreased strength/hardness of the solution heat-treated nickel-base alloys, it is not necessary to use a helium gas for obtaining a dense deposit of the nickel-base alloys on the article, or to use a very high temperature of the carrier gas or high velocity of the feedstock material. Therefore, in one embodiment of the invention, a carrier gas having at least 50 volume % of nitrogen is used for the cold spray. In one embodiment, the carrier gas includes at least 75 volume % of nitrogen. In one embodiment, the carrier gas consists essentially of nitrogen. In one embodiment, the carrier gas used for depositing is essentially free of helium. In one embodiment, the carrier gas temperature is in the range from about 20° C. to about 1200° C. (e.g., about 500° C. to about 1100° C., such as about 650° C. to about 1100° C.). In general, in the cold spray process, an impact critical velocity of the feedstock material is defined as below which the particle adhesion to the substrate is not useful for the intended application. The critical velocity of the feedstock material may depend on the feedstock particles and the substrate nature and properties. In one embodiment, operating the cold spray device used herein comprises accelerating the feedstock to a velocity in the range from about 500 m/s to about 1100 m/s.

Figure 4:
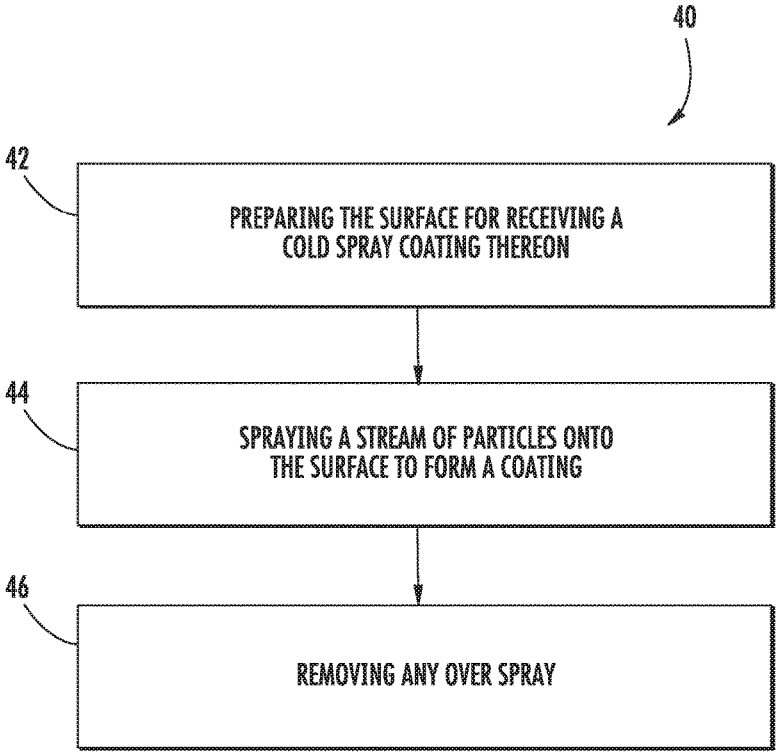
FIG. 4 shows a diagram of an exemplary method of repairing a Ni-based alloy component.

FIG. 4 shows an exemplary method 40 of forming a coating on a component, and may include any of the description above. At 42, the surface of the coating is prepared for receiving a cold spray coating thereon. At 44, a stream of particles is sprayed onto the surface to form a coating thereon. At 46, any over-spray of the particles is removed from the surface. For example, the over-spray portion of the coating may be removed via machining (e.g., grinding), chemical etching, etc.

EXAMPLES

Cold spray techniques were shown to offer significant advantage in terms of solid state material deposition with superior adhesion, no oxidation, thicker coating and smaller material property debits. The application of RENE 77 cold spray coating was demonstrated to a thickness of greater than 3 mm with good adhesive strength and low porosity. The coatings formed after heat treatment had a tensile strength that is 125% of cast RENE 77 tensile strength. This example used a RENE 77 powder feed for coating on a component made of same material.

The coating was formed by cold spraying of RENE 77 using a powder feeding system which feeds the metal powder to a pre-heater, which pre-heated the powders. The pre-heated powders were transported by carrier gas ($N_2$) through a convergent-divergent nozzle which accelerated the powder particles to supersonic velocities. The high speed particles were made to impact the substrate kept a stand-off distance. The impact caused the powders to deform and deposit on the substrate forming the coatings/metal build-up. Thick RENE 77 coatings having a thickness of greater than 3 mm were formed with good adhesive strength and low porosity. The coatings were heat treated at about 1205° C., and were found to have a tensile strength that was 125% of cast RENE77 tensile strength. Detailed microstructural analysis of the coated coupons indicated that a good interface was formed with high density (minimal porosity).

This written description uses exemplary embodiments to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of repairing a Ni-based alloy component, the method comprising:

preparing a surface to be repaired of the Ni-based alloy component for receiving a cold spray repair, wherein the surface to be repaired has a damaged portion that includes a defect therein, wherein the defect extends about 1.5 mm to about 6 mm into the surface of the Ni-based alloy component;

spraying Ni-based alloy particles carried by a high pressure gas stream onto the surface of the Ni-based alloy component to form a coating within the defect of the damaged portion of the surface, wherein the Ni-based alloy particles have a melting point; and wherein the Ni-based alloy particles are sprayed at a spray temperature that is less than the melting point of the Ni-based alloy particles, and wherein the spray temperature is about 500° C. to about 1100° C.;

removing any over-spray on the surface of the Ni-based alloy component;

solution heat treating the coating on the surface of the Ni-based alloy component, wherein heat treating the coating comprises heating the coating to a heat treatment temperature of about 900° C. to about 1300° C. for a period of about 30 minutes to about 5 hours; and after solution heat treating the coating, quenching the coating from the heat treatment temperature to a temperature that is less than a gamma-prime temperature and a gamma-double prime solvus temperature of the Ni-based alloy particles such that a matrix phase of gamma nickel and gamma-prime primary precipitate is present in the coating.

2. The method of claim 1, wherein the coating has a thickness of about 1.5 mm to about 6 mm within the defect.

3. The method of claim 1, wherein the coating has a thickness of about 2.5 mm to about 5 mm within the defect.

4. The method of claim 1, wherein the coating has a thickness of about 3.0 mm to about 5 mm within the defect.

5. The method of claim 1, wherein the Ni-based alloy particles are sprayed at a spray temperature of about 650° C. to about 800° C.

6. The method of claim 1, wherein the high pressure gas stream is selected from the group consisting of helium gas, nitrogen gas, atmospheric air, argon, and mixtures thereof.

7. The method of claim 1, wherein the Ni-based alloy particles have a composition identical to the Ni-based alloy component as originally formed.

8. The method of claim 1, wherein the Ni-based alloy particles have an average size of about 1 μm to about 100 μm.

9. The method of claim 1, wherein the Ni-based alloy particles have an average size of about 5 μm to about 50 μm.

10. The method of claim 1, wherein the coating has a tensile strength that is about 100% to about 130% of the tensile strength of the original Ni-based alloy component, and wherein the coating has a porosity of about 5% or less after heat treatment.

11. The method of claim 1, wherein preparing a surface to be repaired comprises removing an existing material or layer from the surface so that the coating is formed directly on the Ni-based alloy material of the Ni-based alloy component so as to bond directly thereto.

12. The method of claim 1, wherein the coating fills the defect to restore the surface of the Ni-based alloy component.

13. The method of claim 1, spraying the Ni-based alloy particles onto the surface of the Ni-based alloy component to form the coating restores the component to its original dimensions.

14. The method of claim 1, wherein spraying the Ni-based alloy particles onto the surface of the Ni-based alloy component to form the coating within the defect of the damaged portion of the surface, comprises spraying multiple streams of Ni-based alloy particles onto the surface of the Ni-based alloy component to form the coating within the defect of the damaged portion of the surface.

15. The method of claim 1, wherein the coating comprises a hybrid coating having a combination of materials.

16. The method of claim 1, wherein the coating comprises a graded coating composition.

17. The method of claim 1, further comprising:

intermittently changing from the Ni-based alloy particles to a second particle feedstock during the spraying the stream.

* * * * *